US008104299B2

(12) United States Patent
Okamoto et al.

(10) Patent No.: US 8,104,299 B2
(45) Date of Patent: Jan. 31, 2012

(54) AIR CONDITIONER

(75) Inventors: Tetsuya Okamoto, Sakai (JP); Shinichi Kasahara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 409 days.

(21) Appl. No.: 12/375,242

(22) PCT Filed: Jul. 24, 2007

(86) PCT No.: PCT/JP2007/064471
§ 371 (c)(1),
(2), (4) Date: Jan. 27, 2009

(87) PCT Pub. No.: WO2008/015930
PCT Pub. Date: Feb. 7, 2008

(65) Prior Publication Data

US 2010/0281895 A1 Nov. 11, 2010

(30) Foreign Application Priority Data

Aug. 3, 2006 (JP) ..... 2006-211937

(51) Int. Cl.
*F25B 13/00* (2006.01)
*F25B 49/00* (2006.01)

(52) U.S. Cl. ..... 62/157; 62/160; 62/228.3; 62/229; 62/324.6

(58) Field of Classification Search ..... 62/160, 62/228.3, 229, 324.1, 324.6, 157, 222, 231
See application file for complete search history.

(56) References Cited

U.S. PATENT DOCUMENTS

| | | | | |
|---|---|---|---|---|
| 2005/0284164 | A1* | 12/2005 | Ohta | 62/228.3 |
| 2006/0218948 | A1* | 10/2006 | Otake et al. | 62/160 |
| 2007/0068178 | A1* | 3/2007 | Honma et al. | 62/160 |
| 2009/0013700 | A1* | 1/2009 | Unezaki et al. | 62/77 |

FOREIGN PATENT DOCUMENTS

| | | | |
|---|---|---|---|
| JP | 1-269872 | A | 10/1989 |
| JP | 11-182970 | A | 7/1999 |
| JP | 2001-194017 | A | 7/2001 |
| JP | 2002-130770 | A | 5/2002 |
| JP | 2003-074995 | A | 3/2003 |
| JP | 2003-074996 | A | 3/2003 |
| JP | 2005-016754 | A | 1/2005 |
| JP | 2005-249384 | A | 9/2005 |
| JP | 2006-153349 | A | 6/2006 |
| WO | WO 2006/006578 | A1 | 1/2006 |

OTHER PUBLICATIONS

Japanese Office Action of corresponding JP Application No. 2006-211937 dated Jun. 28, 2011.
Japanese Office Action of corresponding Japanese Application No. 2006-211937 dated Nov. 29, 2011.

* cited by examiner

*Primary Examiner* — Marc Norman
(74) *Attorney, Agent, or Firm* — Global IP Counselors

(57) ABSTRACT

An air conditioner includes an indoor heat exchanger (radiator) and a controller. The radiator causes heat radiation to be performed with respect to air from a supercritical refrigerant during heating operation. The controller controls a room temperature by causing a high-pressure side pressure and a refrigerant outlet temperature of the radiator to reach respective target values. Preferably, the controller detects a refrigerant outlet temperature of the radiator with an outlet temperature sensor and detects a room temperature with a room temperature sensor. The controller increases or decreases a target value of the high-pressure side pressure when the controller has judged that there is an excess or a deficiency of capacity in view of the room temperature inside a room that is to be heated even when the refrigerant outlet temperature of the radiator has reached a target value during heating.

8 Claims, 5 Drawing Sheets

AIR CONDITIONER

CROSS-REFERENCE TO RELATED APPLICATIONS

This U.S. National stage application claims priority under 35 U.S.C. §119(a) to Japanese Patent Application No. 2006-211937, filed in Japan on Aug. 3, 2006, the entire contents of which are hereby incorporated herein by reference.

TECHNICAL FIELD

The present invention relates to an air conditioner that uses a refrigerant whose high-pressure side is operated at a supercritical pressure.

BACKGROUND ART

From the standpoints of protecting the global environment and improving efficiency, applied review of a supercritical refrigerant whose high-pressure side is operated at a supercritical pressure as a refrigerant of an air conditioner is being performed (e.g., see Patent Document 1). The air conditioner described in JP-A No. 2002-130770 is configured to use $CO_2$ refrigerant, control a high-pressure side pressure in response to the value of a refrigerant outlet temperature of a radiator in a range where a coefficient of performance COP becomes near a maximum, and perform operation where the coefficient of performance COP is high.

SUMMARY OF THE INVENTION

Problem that the Invention is to Solve

However, in an air conditioner that utilizes a supercritical refrigerant, sometimes the room temperature does not reach a setting temperature despite the refrigerant outlet temperature of the radiator having reached a target value during heating, and in Patent Document 1, a solution with respect to that problem is not disclosed.

It is an object of the present invention to provide an air conditioner that utilizes a supercritical refrigerant and can always exhibit necessary heating capacity.

Means for Solving the Problem

An air conditioner pertaining to a first aspect of the present invention comprises a radiator and a controller. The radiator causes heat radiation to be performed with respect to air from a supercritical refrigerant during heating operation. The controller controls a room temperature inside a room that is an air conditioning target by causing a high-pressure side pressure of a refrigeration cycle that includes the radiator and a refrigerant outlet temperature of the radiator to reach respective target values that have been set beforehand. Additionally, the controller increases or decreases the target value of the high-pressure side pressure when an excess or a deficiency of heating operation capability has been recognized from the room temperature despite the high-pressure side pressure and the refrigerant outlet temperature having reached the target values.

In this air conditioner, the high-pressure side pressure is equal to or greater than a supercritical pressure and, with respect to an increase or a decrease in the high-pressure side pressure, the refrigerant output temperature of the radiator moves on an isotherm and is constant. Therefore, there is an excess of capacity when the high-pressure side pressure is high and there is a deficiency of capacity when the high-pressure side pressure is low. Thus, the controller increases or decreases the high-pressure side pressure and adjusts heating capacity while monitoring the refrigerant outlet temperature and the room temperature. For this reason, a deficiency of capacity is eliminated and comfort improves. Moreover, excess capacity is also eliminated, so this saves energy.

An air conditioner pertaining to a second aspect of the present invention comprises the air conditioner pertaining to the first aspect of the present invention, wherein the controller increases the target value of the high-pressure side pressure when a predetermined amount of time has elapsed without the room temperature reaching a setting temperature.

In this air conditioner, during heating, a situation where a deficiency of capacity is continued for a long period of time is avoided. For this reason, heating comfort improves.

An air conditioner pertaining to a third aspect of the present invention comprises the air conditioner pertaining to the first aspect of the present invention, wherein the controller increases the target value of the high-pressure side pressure when an estimated time of arrival at a setting temperature that has been calculated from a time derivative of the room temperature has exceeded a predetermined threshold.

In this air conditioner, the controller predicts transitioning of the room temperature and adjusts capacity. For this reason, a deficiency of capacity is avoided in advance, and heating comfort improves.

An air conditioner pertaining to a fourth aspect of the present invention comprises the air conditioner pertaining to the first aspect of the present invention, wherein the controller lowers the target value of the high-pressure side pressure when the difference between the refrigerant outlet temperature and the room temperature has become smaller than a prescribed value that has been set beforehand.

In this air conditioner, excess capacity is eliminated, which saves energy.

An air conditioner pertaining to a fifth aspect of the present invention comprises the air conditioner pertaining to the first aspect of the present invention and further comprises an outlet temperature sensor and a room temperature sensor. The outlet temperature sensor detects the refrigerant outlet temperature of the radiator. The room temperature sensor detects the room temperature. Additionally, the controller determines a range of increase or decrease of the target value of the high-pressure side pressure from the difference between an output value of the outlet temperature sensor and an output value of the room temperature sensor.

In this air conditioner, the controller increases or decreases the high-pressure side pressure and adjusts heating capacity while monitoring the refrigerant outlet temperature and the room temperature. For this reason, a deficiency of capacity is eliminated and comfort improves. Moreover, excess capacity is also eliminated, so this saves energy.

An air conditioner pertaining to a sixth aspect of the present invention comprises the air conditioner pertaining to the first aspect of the present invention and further comprises plural indoor units in which the radiator is installed. Additionally, the controller monitors the difference between the refrigerant outlet temperature of the radiator and the room temperature for each of the indoor units and increases or decreases the target value of the high-pressure side pressure.

In this air conditioner, the controller increases or decreases the high-pressure side pressure in response to the necessary capacity of each of the indoor units. For this reason, the necessary capacity is exhibited in all of the indoor units, and heating comfort improves.

An air conditioner pertaining to a seventh aspect of the present invention comprises the air conditioner pertaining to the sixth aspect of the present invention, wherein a prescribed value with respect to the difference between the refrigerant outlet temperature of the radiator and the room temperature is set, and the controller lowers the target value of the high-pressure side pressure when the difference has become smaller than the prescribed value.

In this air conditioner, excess capacity of the indoor units is eliminated, so this saves energy.

An air conditioner pertaining to an eighth aspect of the present invention comprises the air conditioner pertaining to the first aspect of the present invention, wherein the refrigeration cycle includes a refrigerant circuit that is configured as a result of a compressor, the radiator, an expansion mechanism and an evaporator being sequentially connected.

The high-pressure side pressure is pressure that the refrigerant that is present inside the refrigerant circuit receives in a section that leads from a refrigerant discharge opening in the compressor, through the radiator, and to a refrigerant inlet in the expansion mechanism.

In this air conditioner, the controller can eliminate an excess or a deficiency of capacity by increasing or decreasing the pressure of the refrigerant in the section that leads from the refrigerant discharge opening in the compressor to the refrigerant inlet in the expansion mechanism.

EFFECTS OF THE INVENTION

In the air conditioner pertaining to the first aspect of the present invention, during heating, the controller increases or decreases the target value of the high-pressure side pressure and adjusts heating capacity while monitoring the refrigerant outlet temperature and the room temperature. For this reason, a deficiency of capacity is eliminated and comfort improves. Moreover, excess capacity is also eliminated, so this saves energy.

In the air conditioner pertaining to the second aspect of the present invention, during heating, a situation where a deficiency of capacity is continued for a long period of time is avoided. For this reason, heating comfort improves.

In the air conditioner pertaining to the third aspect of the present invention, during heating, the controller predicts transitioning of the room temperature and adjusts capacity. For this reason, a deficiency of capacity is avoided in advance, and heating comfort improves.

In the air conditioner pertaining to the fourth aspect of the present invention, during heating, excess capacity is eliminated, which saves energy.

In the air conditioner pertaining to the fifth aspect of the present invention, during heating, the controller increases or decreases the high-pressure side pressure and adjusts heating capacity while monitoring the refrigerant outlet temperature and the room temperature. For this reason, a deficiency of capacity is eliminated and comfort improves. Moreover, excess capacity is also eliminated, so this saves energy.

In the air conditioner pertaining to the sixth aspect of the present invention, during heating, the controller increases or decreases the high-pressure side pressure in response to the necessary capacity of each of the indoor units. For this reason, the necessary capacity is exhibited in all of the indoor units, and heating comfort improves.

In the air conditioner pertaining to the seventh aspect of the present invention, during heating, excess capacity of the indoor units is eliminated, so this saves energy.

In the air conditioner pertaining to the eighth aspect of the present invention, the controller can eliminate an excess or a deficiency of capacity by increasing or decreasing the pressure of the refrigerant in the section that leads from the refrigerant discharge opening in the compressor to the refrigerant inlet in the expansion mechanism.

BRIEF DESCRIPTION OF THE DRAWINGS

FIG. 2(*b*) is a pressure-enthalpy diagram of a supercritical refrigeration cycle that uses $CO_2$.

DETAILED DESCRIPTION OF THE INVENTION

<Configuration of Air Conditioner>

Figure 1:
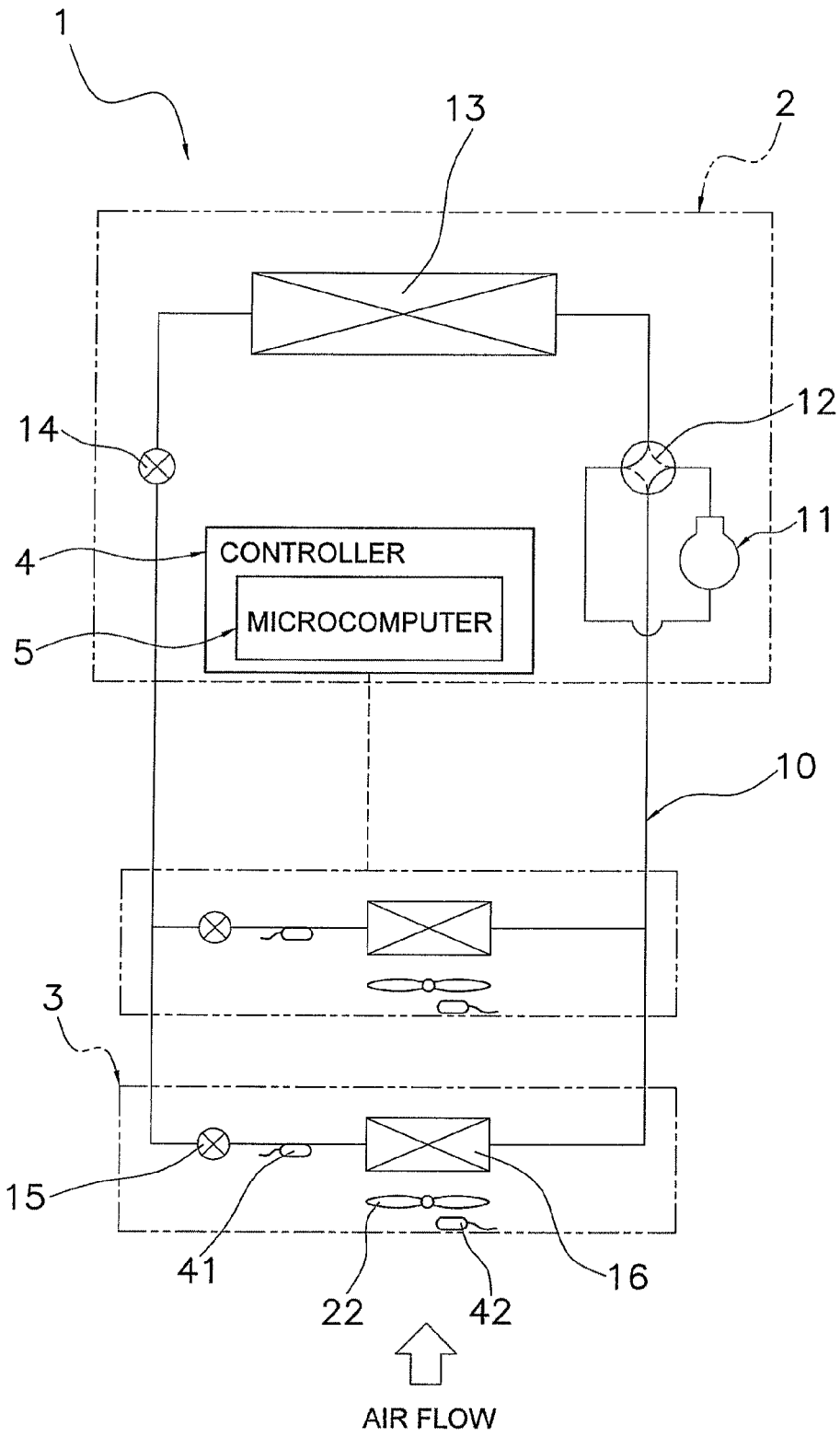
FIG. 1 is a configural diagram of an air conditioner pertaining to an embodiment of the present invention.

FIG. 1 is a configural diagram of an air conditioner pertaining to an embodiment of the present invention. An air conditioner 1 uses, as a refrigerant, $CO_2$ whose high-pressure side becomes equal to or greater than a critical pressure.

The air conditioner 1 is a multi type air conditioner for a building; plural indoor units 3 are connected in parallel with respect to one or plural outdoor units 2, and devices such as a compressor 11, a four-way switch valve 12, an outdoor heat exchanger 13, an outdoor expansion valve 14 and indoor expansion valves 15, which are expansion mechanisms, and indoor heat exchangers 16 are connected such that the refrigerant can flow, whereby a refrigerant circuit 10 is formed. Indoor fans 22 cause indoor air to be introduced to the indoor heat exchangers 16.

Further, outlet temperature sensors 41 are disposed on pipes on refrigerant outlet sides (during heating) of the indoor heat exchangers 16, and room temperature sensors 42 are disposed on air suction sides of the indoor heat exchangers 16.

<Operation of Air Conditioner>

(Cooling Operation)

During cooling operation, the four-way switch valve 12 is connected as indicated by the dotted lines in FIG. 1 such that the compressor 11 and the outdoor heat exchanger 13 become communicatively connected, and the indoor heat exchangers 16 and the outdoor heat exchanger 13 respectively function as evaporators and a radiator. That is, high temperature/high pressure refrigerant gas that has been discharged from the compressor 11 is introduced to the outdoor heat exchanger 13. Here, after heat exchange between the refrigerant gas and outdoor air has been performed, the intermediate temperature/high pressure gas is depressurized by the indoor expansion valves 15, becomes low temperature/low pressure two-phase refrigerant, and is introduced to the indoor heat exchangers 16. Here, after heat exchange with indoor air has been performed, the refrigerant is again sucked into the compressor 11.

(Heating Operation)

During heating operation, the four-way switch valve 12 is connected as indicated by the solid lines in FIG. 1 such that the compressor 11 and the indoor heat exchangers 16 become communicatively connected, and the indoor heat exchangers 16 and the outdoor heat exchanger 13 respectively function as radiators and an evaporator. That is, high temperature/high pressure refrigerant gas that has been discharged from the compressor 11 is introduced to the indoor heat exchangers 16. Here, after heat exchange between the refrigerant gas and indoor air has been performed, the intermediate temperature/high pressure gas passes through pipes, is depressurized by the outdoor expansion valve 14, and is introduced to the outdoor heat exchanger 13. Here after heat exchange with outdoor air has been performed, the refrigerant is again sucked into the compressor 11.

<Controller>

A controller 4 monitors values that have been detected by the outlet temperature sensors 41 that are disposed in the refrigerant outlets of the indoor heat exchangers 16 and the room temperature sensors 42 that are disposed on the air suction sides of the indoor heat exchangers 16 and controls the openings of the outdoor expansion valve 14 and the indoor expansion valves 15 and the operating frequency of the compressor 11.

A microcomputer 5 and a memory (not shown) are installed in the controller 4, and the microcomputer 5 calculates a target value of high-pressure side pressure on the basis of the values that have been detected by the outlet temperature sensors 41 and the room temperature sensors 42. It will be noted that the "high-pressure side pressure" is, for example, in the case of during heating, pressure that the refrigerant that is present inside the refrigerant circuit 10 receives in a section that leads from a refrigerant discharge opening in the compressor 11, through the indoor heat exchangers 16, and to a refrigerant inlet in the outdoor expansion valve 14.

<Capacity Control of Supercritical Refrigeration Cycle>

Figure 2A:
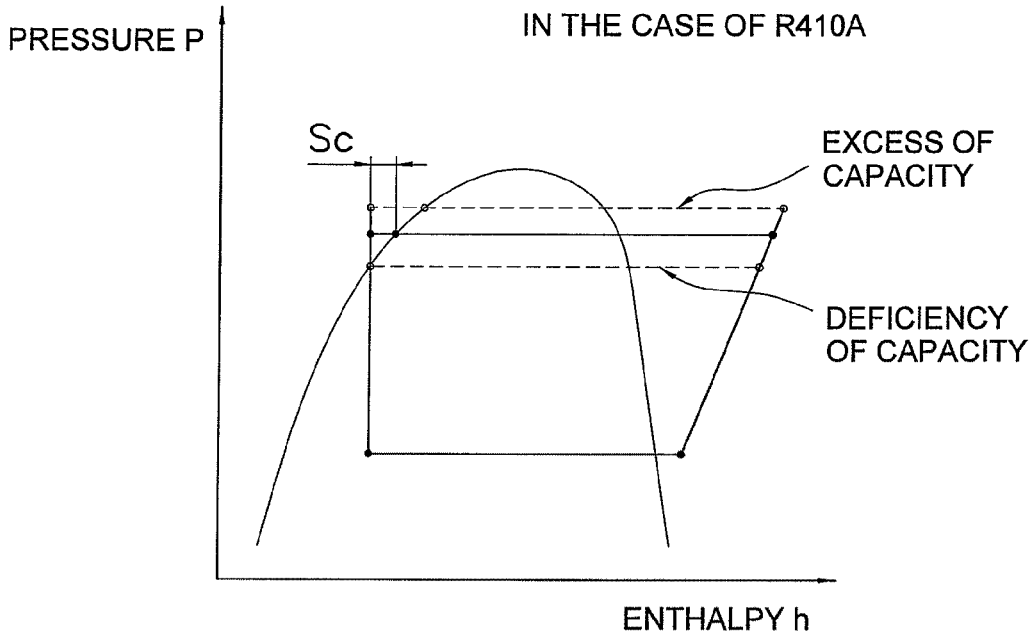
FIG. 2(*a*) is a pressure-enthalpy diagram of a refrigeration cycle that uses R410A.
Figure 2B:
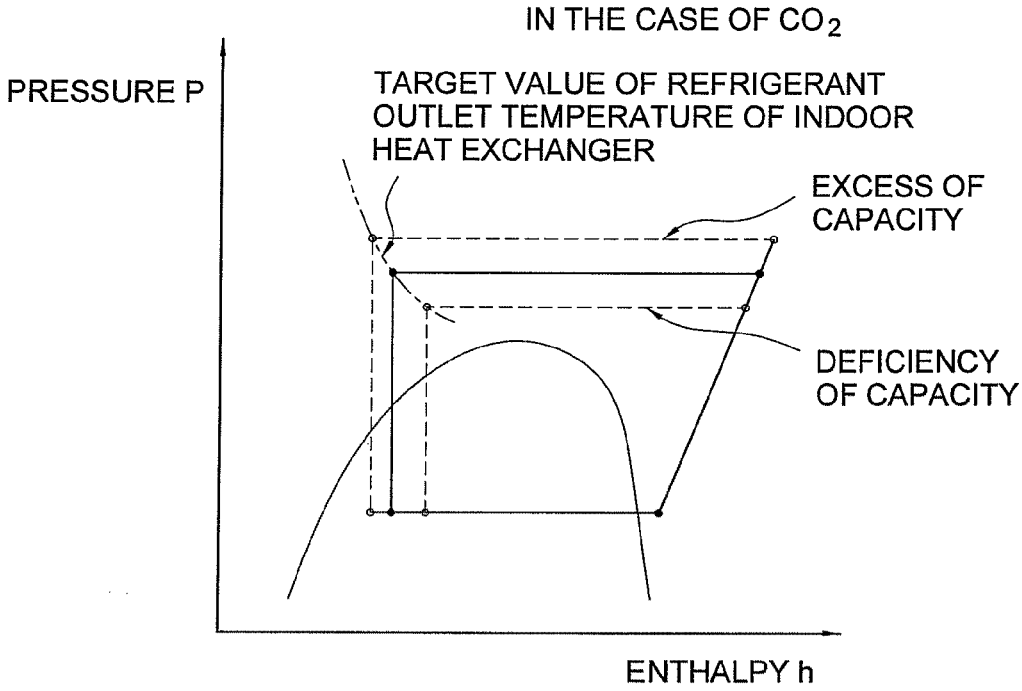

Here, the difference between a conventional refrigeration cycle and a supercritical refrigeration cycle will be described. FIG. 2(*a*) is a pressure-enthalpy line diagram of a refrigeration cycle that uses R410A, and FIG. 2(*b*) is a pressure-enthalpy line diagram of a supercritical refrigeration cycle that uses $CO_2$.

In FIG. 2(*a*), in the conventional refrigeration cycle, it is judged that there is an excess of capacity when a supercooling degree Sc is surpassed in all of the indoor units and it is judged that there is a deficiency of capacity when the supercooling degree Sc has not been reached at all even in one of all of the indoor units, and capacity adjustment is performed by increasing or decreasing the high-pressure side pressure.

However, in the supercritical refrigeration cycle, as shown in FIG. 2(*b*), there is no concept of supercooling, and when the room temperature has not reached a setting temperature despite the refrigerant outlet temperature of the indoor heat exchangers having reached the target value, it is judged that there is an excess of capacity when the high-pressure side pressure is high and it is judged that there is a deficiency of capacity when the high-pressure side pressure is low, and capacity adjustment is performed by increasing or decreasing the high-pressure side pressure.

(Heating Capacity Control)

Figure 3:
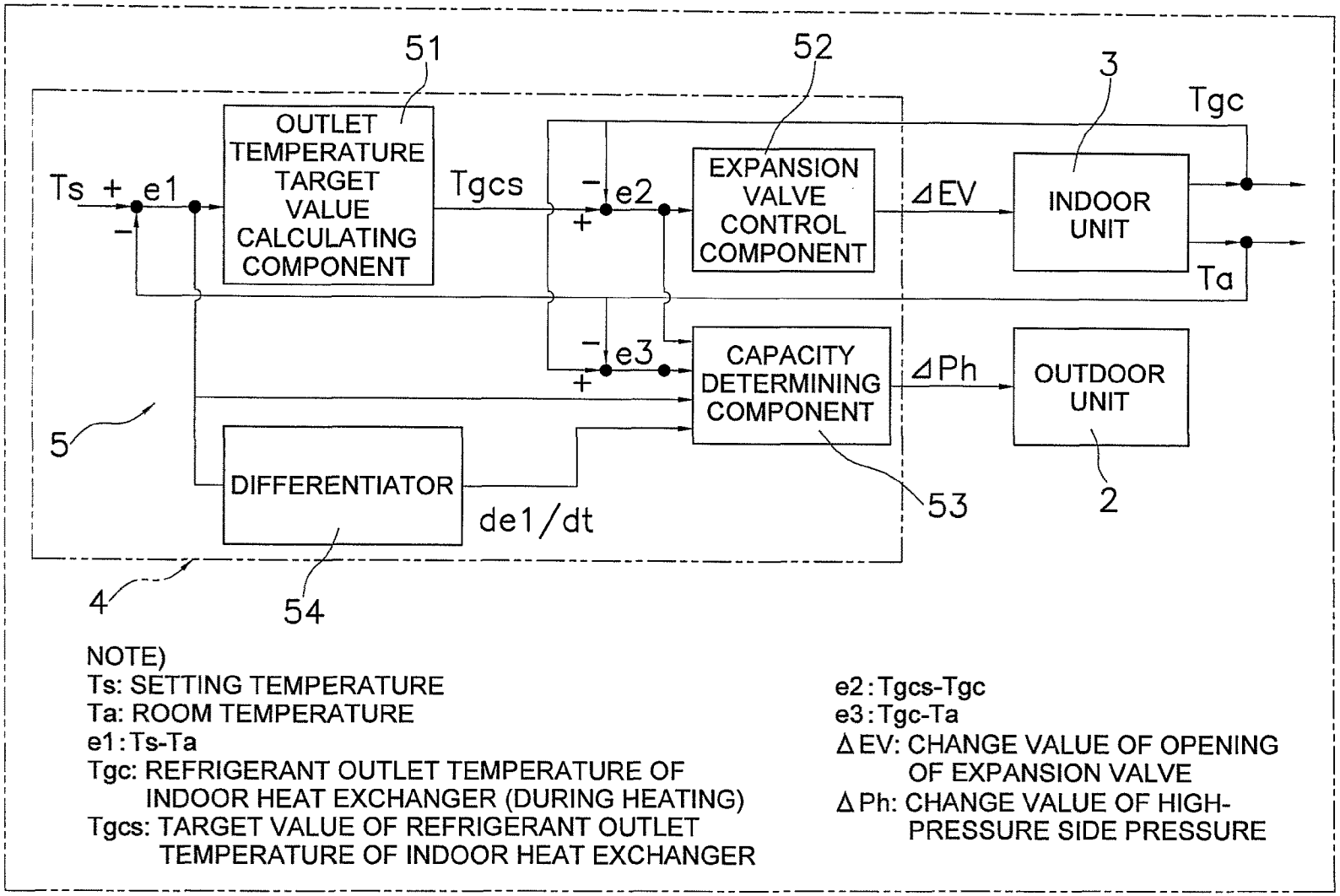
FIG. 3 is a control block diagram of heating capacity control.
Figure 4:
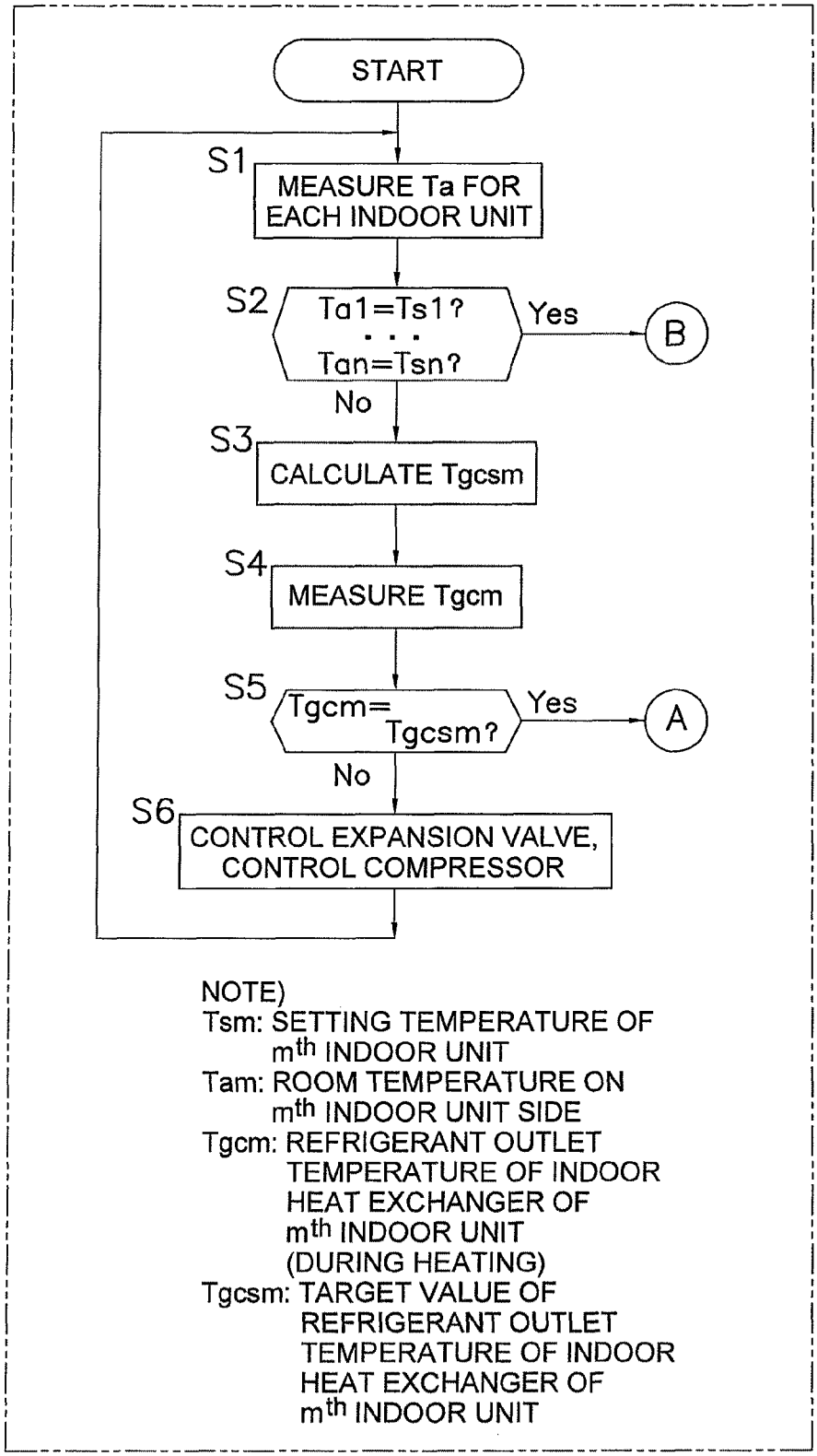
FIG. 4 is a flowchart of the heating capacity control.
Figure 5:
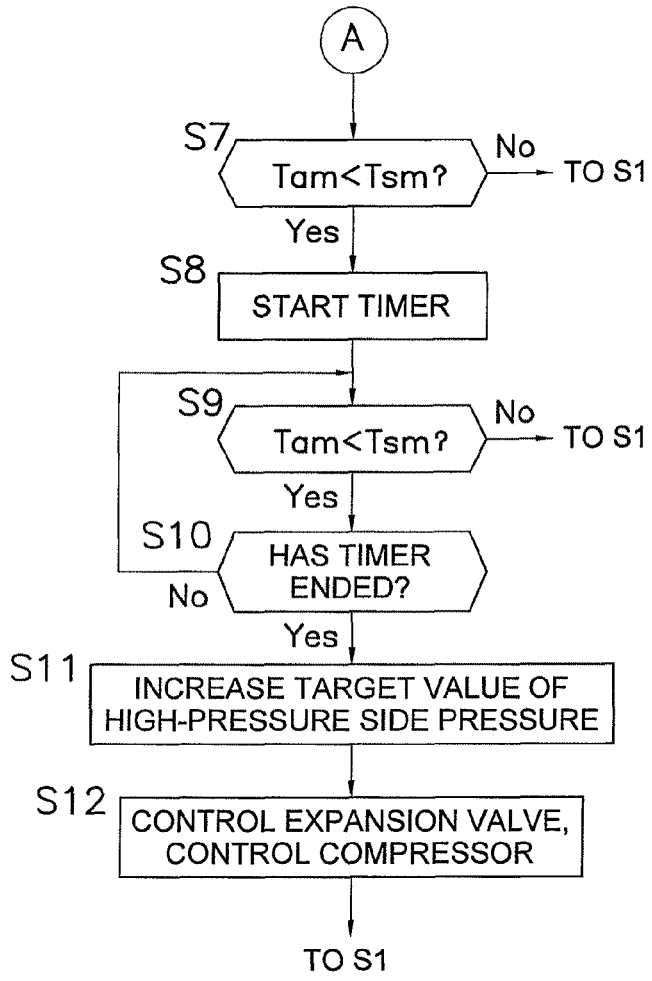
FIG. 5 is a flowchart of the heating capacity control.
Figure 6:
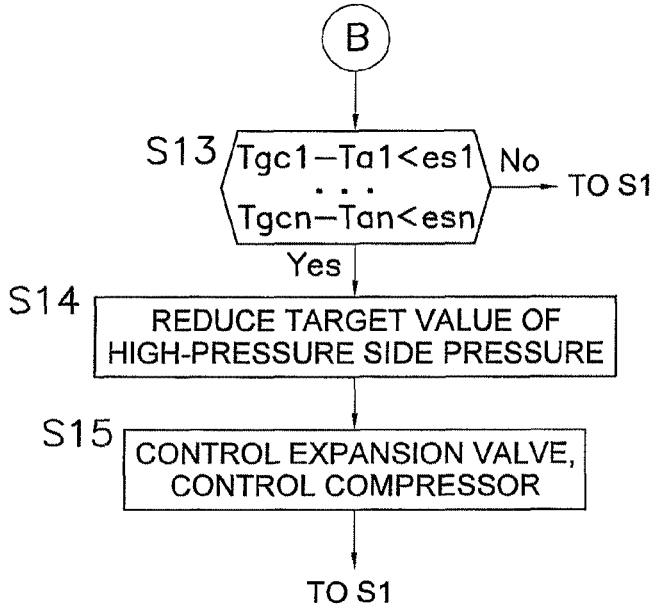
FIG. 6 is a flowchart of the heating capacity control.

Next, heating capacity control by the microcomputer 5 of the controller 4 will be described. FIG. 3 is a control block diagram of the heating capacity control, and FIG. 4 is a flowchart of the heating capacity control. As for control of heating operation in the air conditioner 1, the microcomputer 5 controls the high-pressure side pressure necessary to ensure heating capacity by the operating frequency of the compressor 11 and controls the refrigerant outlet state of the indoor heat exchangers 16 by the opening of the outdoor expansion valve 14.

In FIG. 3, the microcomputer 5 calculates, in an outlet temperature target value calculating component 51, a target value Tgcs of a refrigerant outlet temperature Tgc of the indoor heat exchangers 16 on the basis of a temperature difference e1 between a setting temperature Ts and a room temperature Ta. Next, the microcomputer 5 calculates, in an expansion valve control component 52, an opening change value dEV of the expansion valve on the basis of a temperature difference e2 between the target value Tgcs and the refrigerant outlet temperature Tgc and controls the valve opening of the outdoor expansion valve 14.

Further, at the same time, the microcomputer 5 determines, in a capacity determining component 53, whether there is an excess or a deficiency of heating capacity on the basis of the temperature difference e1, the temperature difference e2 and a temperature difference e3 between the refrigerant outlet temperature Tgc and the room temperature Ta, calculates a high-pressure side pressure change value dPh, and thereafter mainly controls the operating frequency of the compressor 11 of the outdoor unit 2.

It will be noted that, when determining whether there is an excess or a deficiency of capacity, the microcomputer 5 may also calculate, with a differentiator 54, a derivative value de1/dt of the temperature difference e1.

In the present embodiment, the microcomputer 5 increases the target value of the high-pressure side pressure when a state where the room temperature Ta has not reached the setting temperature Ts continues for a predetermined amount of time despite the refrigerant outlet temperature Tgc of the indoor heat exchanger 16 having reached the target value Tgcs in each of the indoor units 3. Additionally, after the room temperature Ta has reached the setting temperature Ts in each of the indoor units 3, when the difference between the refrigerant outlet temperature Tgc and the room temperature Ta has become smaller than a prescribed value es that has been set for each of the indoor units 3, the microcomputer 5 lowers the target value of the high-pressure side pressure with respect to those indoor units 3.

Below, a flow of the heating capacity control will be described using FIG. 4. In step S1, the microcomputer 5 acquires a room temperature Tan from the room temperature sensor 42 for each of the indoor units 3. It will be noted that an alphabetical letter at the end of the variable represents the number of the indoor units 3; for example, "Tsm" and "Tsn" represent the setting temperature Ts of the $m^{th}$ and $n^{th}$ indoor units 3.

In step S2, the microcomputer 5 determines whether or not the room temperature Tan has reached the setting temperature Tsn for each of the indoor units 3. When the microcomputer 5 determines that the answer is NO in the $m^{th}$ indoor unit 3 in step S2, the microcomputer 5 proceeds to step S3 and calculates the target value Tgcsm of the refrigerant outlet temperature of the indoor heat exchanger 16 with respect to the $m^{th}$ indoor unit 3. In step S4, the microcomputer 5 acquires the refrigerant outlet temperature Tgcm of the indoor heat exchanger 16 with respect to the $m^{th}$ indoor unit 3. In step S5, the microcomputer 5 determines whether or not the refrigerant outlet temperature Tgcm has reached the target vale Tgcsm with respect to the $m^{th}$ indoor unit 3. When the microcomputer 5 determines that the answer is NO in step S5, the microcomputer 5 proceeds to step S6, controls the compressor 11 and the outdoor expansion valve 14 such that the refrigerant outlet temperature Tgcm reaches the target value Tgcsm, and returns to step S1.

When the microcomputer 5 determines that the answer is YES in step S5, the microcomputer 5 moves to control A and determines in step S7 whether or not the room temperature Tam on the $m^{th}$ indoor unit 3 side is less than the setting temperature Tsm of the $m^{th}$ indoor unit 3. When the microcomputer 5 determines that the answer is YES in step S7, the microcomputer 5 proceeds to step S8, starts a timer and counts a predetermined amount of time. It will be noted that the microcomputer 5 returns to S1 when the microcomputer 5 determines that the answer is NO in step S7.

In step S9, the microcomputer 5 determines whether or not the room temperature Tam is still less than the setting temperature Tsm. When the microcomputer 5 determines that the answer is YES in step S9, the microcomputer 5 proceeds to step S10 and determines whether or not the timer has ended. Step S7 to step S10 are control to determine whether or not a state where the room temperature Tam is less than the setting temperature Tsm has continued for a predetermined amount of time, so if the microcomputer 5 determines that the answer is NO in step S9, the microcomputer 5 returns to step S1.

When the microcomputer 5 determines that the timer has ended in step S10, the microcomputer 5 judges that there is a deficiency of capacity, proceeds to step S11 and increases the target value of the high-pressure side pressure. In step S12, the microcomputer 5 controls the compressor 11 and the outdoor expansion valve 14 in order to achieve the target value of the high-pressure side pressure that was set in step S11 and returns to step S1.

Further, when the microcomputer 5 determines that the answer is YES in step S2, the microcomputer 5 moves to control B and determines in step S13 for each of the indoor units 3 whether or not the difference between the refrigerant outlet temperature Tgcn and the room temperature Tan is smaller than the prescribed value esn that has been set beforehand. When the microcomputer 5 determines that the answer is YES even in one of the indoor units in step S13, the microcomputer 5 judges that there is an excess of capacity in the indoor unit 3 for which the answer was determined to be YES, proceeds to step S14 and reduces the target value of the high-pressure side pressure with respect to the indoor unit 3 for which the answer was determined to be YES in step S13. It will be noted that the microcomputer 5 returns to S1 when the microcomputer 5 determines that the answer is NO in step S13. In step S15, the microcomputer 5 controls the compressor 11 and the outdoor expansion valve 14 in order to achieve the target value of the high-pressure side pressure that was set in step S14 and returns to step S1.

<Characteristics>

(1)

In the air conditioner 1, the indoor heat exchanger 16 causes heat radiation to be performed with respect to air from the supercritical refrigerant during heating operation. The controller 4 maintains, at a constant, the high-pressure side pressure of the refrigeration cycle that includes the indoor heat exchanger 16. Further, the controller 4 detects the refrigerant outlet temperature Tgc of the indoor heat exchanger 16 with the outlet temperature sensor 41 and detects the room temperature Ta with the room temperature sensor 42.

In a supercritical refrigeration cycle, with respect to an increase or a decrease in the high-pressure side pressure, the refrigerant outlet temperature Tgc of the radiator (e.g., the indoor heat exchanger 16 during heating) moves on an isotherm and is constant. Therefore, there is an excess of capacity when the high-pressure side pressure is high and a deficiency of capacity when the high-pressure side pressure is low.

Thus, the controller 4 increases or decreases the target value of the high-pressure side pressure when the controller 4 has judged that, despite the refrigerant outlet temperature Tgc of the indoor heat exchanger 16 having reached the target value Tgcs during heating, there is an excess or a deficiency of capacity in view of the room temperature Ta of the room that is to be heated.

In this manner, the air conditioner 1 can increase or reduce the high-pressure side pressure and adjust heating capacity while monitoring the refrigerant outlet temperature Tgc and the room temperature Ta during heating, so a deficiency of capacity is eliminated and comfort improves. Moreover, excess capacity is also eliminated, so this saves energy.

Further, the air conditioner 1 increases the target value of the high-pressure side pressure when a predetermined amount of time has elapsed without the room temperature Ta reaching the setting temperature Ts or when an estimated time of arrival at the setting temperature Ts that has been calculated from a time derivative of the room temperature Ta has exceeded a predetermined threshold. For this reason, during heating, there is no situation where a deficiency of capacity is continued for a long period of time, and heating comfort improves.

Further, the air conditioner 1 lowers the target value of the high-pressure side pressure when the difference between the refrigerant outlet temperature Tgc and the room temperature Ta has become smaller than the prescribed value es that has been set beforehand, so during heating, excess capacity is eliminated, which saves energy.

(2)

The air conditioner 1 is disposed with the plural indoor units 3. Additionally, the controller 4 monitors the difference between the refrigerant outlet temperature Tgc of the indoor heat exchanger 16 and the room temperature Ta for each of the indoor units 3 and increases or decreases the target value of the high-pressure side pressure. For this reason, the air conditioner 1 can increase or decrease the high-pressure side pressure in response to the necessary capacity of each of the indoor units 3 during heating, the necessary capacity is exhibited in all of the indoor units, and heating comfort improves.

Further, the air conditioner 1 sets the prescribed value es with respect to the difference between the refrigerant outlet temperature Tgc of the indoor heat exchanger 16 and the room temperature Ta and lowers the target value of the high-pressure side pressure when that difference e has become smaller than the prescribed value. For this reason, during heating, excess capacity of the indoor units is eliminated, so this saves energy.

INDUSTRIAL APPLICABILITY

As described above, the present invention is useful in an air conditioner because it can realize heating capacity according to necessity.

What is claimed is:

1. An air conditioner comprising:

a radiator configured to perform heat radiation with respect to air from a supercritical refrigerant during heating operation; and a controller configured to control a room temperature inside a room by causing a high-pressure side pressure of a refrigeration cycle including the radiator and a refrigerant outlet temperature of the radiator to reach respective target values that have been set beforehand, the controller being further configured to determine a target value of the high-pressure side pressure on the basis of the refrigerant outlet temperature from the radiator and the room temperature, to decrease the target value of the high-pressure side pressure when an excess of heating operation capability has been recognized from the room temperature despite the refrigerant outlet temperature having reached the target values, and to increase the target value of the high-pressure side pressure when a deficiency of heating operation capability has been recognized from the room temperature despite the refrigerant outlet temperature having reached the target values.

2. The air conditioner according to claim 1, wherein the controller is further configured to increase the target value of the high-pressure side pressure when a predetermined amount of time has elapsed without the room temperature reaching a setting temperature.

3. The air conditioner according to claim 1, wherein the controller is further configured to increase the target value of the high-pressure side pressure when an estimated time of arrival at a setting temperature has exceeded a predetermined threshold, the estimated time of arrival at the setting temperature being calculated from a time derivative of the room temperature.

4. The air conditioner according to claim 1, wherein the refrigeration cycle includes a refrigerant circuit having a compressor, the radiator, an expansion mechanism and an evaporator sequentially connected to each other, and the high-pressure side pressure is a pressure that the refrigerant that is present inside the refrigerant circuit receives in a section that leads from a refrigerant discharge opening in the compressor, through the radiator, and to a refrigerant inlet in the expansion mechanism.

5. An air conditioner comprising:

a radiator configured to perform heat radiation with respect to air from a supercritical refrigerant during heating operation; and a controller configured to control a room temperature inside a room by causing a high-pressure side pressure of a refrigeration cycle including the radiator and a refrigerant outlet temperature of the radiator to reach respective target values that have been set beforehand, the controller being further configured to decrease the target value of the high-pressure side pressure when an excess of heating operation capability has been recognized from the room temperature despite the refrigerant outlet temperature having reached the target values, to increase the target value of the high-pressure side pressure when a deficiency of heating operation capability has been recognized from the room temperature despite the refrigerant outlet temperature having reached the target values, and to lower the target value of the high-pressure side pressure when a difference between the refrigerant outlet temperature and the room temperature has become smaller than a prescribed value that has been set beforehand.

6. An air conditioner comprising:

a radiator red to perform heat radiation with respect to air from a supercritical refrigerant during heating operation; and a controller configured to control a room temperature inside a room by causing a high-pressure side pressure of a refrigeration cycle including the radiator and a refrigerant outlet temperature of the radiator to reach respective target values that have been set beforehand;

an outlet temperature sensor configured to detect the refrigerant outlet temperature of the radiator; and a room temperature sensor configured to detect the room temperature, the controller being further configured to decrease the target value of the high-pressure side pressure when an excess of heating operation capability has been recognized from the room temperature despite the refrigerant outlet temperature having reached the target values,and to increase the target value of the high-pressure side pressure when a deficiency of heating operation capability has been recognized from the room temperature despite the refrigerant outlet temperature having reached the target values, and to determine a range of increase or decrease of the target value of the high-pressure side pressure from a difference between an output value of the outlet temperature sensor and an output value of the room temperature sensor.

7. An air conditioner comprising:

plural indoor units, each indoor unit having a radiator configured to perform heat radiation with respect to air from a supercritical refrigerant during heating operation; and a controller configured to control a room temperature for each outdoor unit by causing a high-pressure side pressure of a refrigeration cycle including the radiators and refrigerant outlet temperatures of the radiators to reach respective target values that have been set beforehand, the controller being further configured to decrease the target value of the high-pressure side pressure when an excess of heating operation capability has been recognized from the room temperatures despite the refrigerant outlet temperatures having reached the target values,and to increase the target value of the high-pressure side pressure when a deficiency of heating operation capability has been recognized from the room temperatures despite the refrigerant outlet temperatures having reached the target values, and to monitor a difference between the refrigerant outlet temperature of the radiator and the room temperature for each of the indoor units and to increase or decrease the target value of the high-pressure side pressure based on the temperature differences.

8. The air conditioner according to claim 7, wherein a prescribed value with respect to the difference between the refrigerant outlet temperature of the radiator and the room temperature is set for each of the plural indoor units, and the controller is further configured to lower the target value of the high-pressure side pressure when the difference has become smaller than the prescribed value.

* * * * *